United States Patent [19]

Penrod et al.

[11] Patent Number: 5,060,118

[45] Date of Patent: Oct. 22, 1991

[54] APPARATUS FOR DAYLIGHT COLOR DUPLICATION

[75] Inventors: Richard J. Penrod, Homer; Roy H. McCullagh, Shelocta, both of Pa.

[73] Assignee: Frank A. Arone, Homer City, Pa.

[21] Appl. No.: 334,072

[22] Filed: Apr. 6, 1989

[51] Int. Cl.[5] ..... F21V 7/00

[52] U.S. Cl. ..... 362/1; 362/231; 362/33; 362/295; 362/418; 356/230

[58] Field of Search ..... 362/33, 260, 228, 230, 362/231, 225, 251, 285, 413, 418, 430, 1, 2, 293, 295, 394; 315/320, DIG. 1; 356/230, 232

[56] References Cited

U.S. PATENT DOCUMENTS

| | | | |
|---|---|---|---|
| 136,799 | 12/1943 | Vendope | 362/431 |
| 2,725,461 | 11/1955 | Amour | 362/1 |
| 2,831,966 | 4/1958 | Porteous | 362/2 |
| 3,201,576 | 8/1965 | Scott et al. | 362/1 |
| 3,517,180 | 6/1970 | Semotan | 362/1 |
| 3,794,828 | 2/1974 | Arpino | 362/231 |
| 4,404,619 | 9/1983 | Ferpuson | 362/375 |
| 4,602,448 | 7/1986 | Grove | 362/33 |
| 4,782,428 | 11/1988 | Cowell et al. | 362/225 |

FOREIGN PATENT DOCUMENTS

| | | | |
|---|---|---|---|
| 143048 | 5/1920 | United Kingdom | 362/418 |

*Primary Examiner*—Ira S. Lazarus
*Assistant Examiner*—D. M. Cox
*Attorney, Agent, or Firm*—Webb, Burden Ziesenheim & Webb

[57] ABSTRACT

An apparatus for "color mode switching," which enables duplication of daylight chromaticity for each color family. The present invention emits a selected spectral distribution of light which duplicates the effect of daylight, on a color-by-color basis. This effect is accomplished by a specific arrangement of specialized fluorescent and incandescent lamps which are switched (on/-off) in a different pattern for each color family. The device has application anywhere color matching is required, including the after market for automobiles.

4 Claims, 10 Drawing Sheets

APPARATUS FOR DAYLIGHT COLOR DUPLICATION

FIELD OF THE INVENTION

The present invention relates to color duplication of pigments and paints in the after market for automobiles and in other applications.

BACKGROUND OF THE INVENTION

Color is the property of reflecting light of a particular visible wavelength. Duplication of color of pigments and paints therefore requires attention to the influence of the light source in which the "match" (or lack of it) will be viewed. One of the most unforgiving light sources, for proving or disproving a color match, is "noon daylight," in which paints or pigments which appear the same or very similar under other light sources can take on very different aspects of color.

To attempt to meet the various needs of a variety of industries and applications for which color matching is required, numerous artificial lights have been developed. These lights have approximated daylight to an extent, with varying degrees of success. U.S. Pat. No. 1,249,443 (1917) discloses "corrected" artificial light equivalent to daylight as a part of the claimed device. No specifics elucidate the correction of artificial light in this way, however. U.S. Pat. No. 1,330,028 discloses a "standard light of a given spectral composition, for the purpose of matching colors . . . ," accomplished with a lamp combined with reflectors and deflectors. U.S. Pat. No. 3,093,319 discloses an illuminating device having a plurality of fluorescent and incandescent bulbs, together, which in combination can provide either a progressive range of lighting or a certain number of preselected combinations from the light sources. Fluorescent dustings and filters are disclosed as modifiers for the radiation spectrum emitted by the light sources.

U.S. Pat. No. 3,112,886 explains that "a fixture manufacturer cannot purchase a light source such as a fluorescent tube capable of giving off illumination which is color corrected to standard sun illumination." To address this problem, the fixture includes a reflector, for a standard warm white fluorescent lamp, which is coated with specially selected colored particles or beads.

U.S. Pat. No. 4,651,259 discloses a light reflector comprised of a plurality of elongate prismatic bodies rotating about their longitudinal axis. U.S. Pat. Nos. 3,588,488 and 4,072,856 disclose high-Kelvin light fixtures for medical, dental and surgical applications. U.S. Pat. No. 4,091,441 discloses a fixture containing two types of fluorescent lamps.

Finally, one patent, U.S. Pat. No. 3,201,576 to Scott, contains extensive text pertaining to various approximations of artificial daylight. According to Scott, "daylight" fluorescent tubes, even though whitish, do not duplicate the spectral energy distribution curve for north sky daylight. Combined sources of light did not necessarily overcome the unwanted "blue shift" of daylight bulbs, and included among the disclosed disadvantageous arrangements are fixtures containing both fluorescent and incandescent lights, due to their overheating problems and the relatively lower ratio of lumens output/watts input. Scott discloses and claims an all-fluorescent fixture.

Although pursuit of artificial daylight has a long tradition, success (or lack of it) is exposed by the chromaticity meter, known in the art. When the same color test panel is subjected to "natural daylight" and so-called "artificial daylight," alternately, and separate chromaticity readings are taken under each circumstance, the chromaticity meter readings provide objective evidence of the efficacy with which the artificial daylight has simulated the natural daylight. Those skilled in the art are aware that prior art artificial daylight devices eventuate significantly different chromaticity readings from natural light, when a single color swatch is tested alternately. Therefore, a need remains for a method and apparatus which can illuminate a color test panel and provide a chromaticity meter reading insignificantly different from the chromaticity meter reading of the same color test panel in natural daylight.

SUMMARY OF THE INVENTION

In order to meet this need, the present invention is an apparatus for "color mode switching," that is, a method and apparatus for duplicating daylight chromaticity for each color family. Unlike prior art devices which attempt (unsuccessfully) to reproduce daylight itself, the present invention emits a selected spectral distribution of light which duplicates the effect of daylight, on a color-by-color basis. This effect is accomplished by a specific arrangement of specialized fluorescent and incandescent lamps which are switched (on/off) in a different pattern for each color family. The invention has utility in any color-sensitive application, such as in the after market for automobiles including auto body and painting operations.

DETAILED DESCRIPTION OF THE INVENTION

"Color mode switching" is provided by an apparatus for duplicating daylight chromaticity for each color family. The present fixture emits a selected spectral distribution of light which duplicates the effect of daylight per color. This effect is accomplished by a specific arrangement of specialized fluorescent and incandescent lamps which are switched (on/off) in a different pattern for each color family.

The details concerning the device illustrated in the Figures contribute to an overall understanding of the concept of color mode switching.

Figure 1:
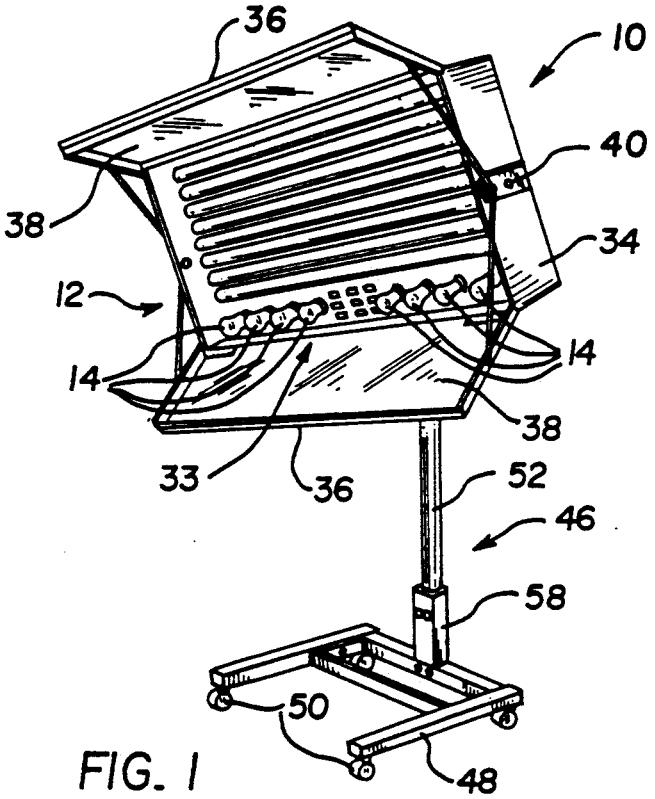
FIG. 1 is a perspective view of the illuminating side of the present invention.

Referring now to FIG. 1, a perspective view of the present invention illustrates the light fixture 10 having the light panel 12. The light panel 12 contains a plurality (eight) of incandescent lamps 14, along with eight fluorescent lamps 18, 20, 22, 24, 26, 28, 30, and 32. The light panel 12 also has the switch assembly 33 visible thereon. The light panel 12 forms the interior portion of a housing body 34, which housing body 34 has housing doors 36 having a reflective surface 38 on the inner surfaces thereof. The reflective surface may be manufactured of a wide variety of materials, but a highly reflective white finish is preferred. As shown in FIG. 1, the housing body 34 and its associated structures is mounted on a base 48 by means of the ratchet rod foot 58 and the ratchet rod 52.

Figure 2:
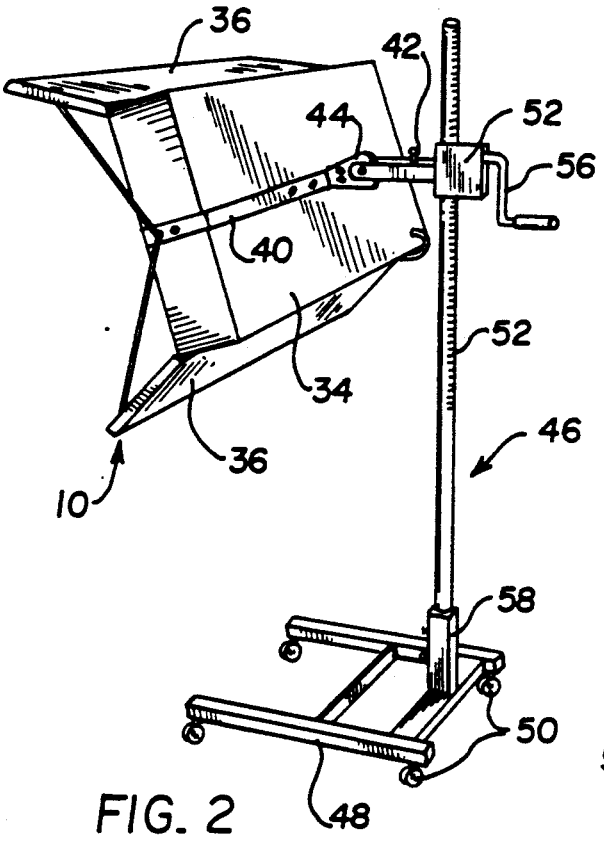
FIG. 2 is a perspective view of the non-illuminating side of the fixture shown in FIG. 1.

Referring now to FIG. 2, the non-illuminating side of the light fixture 10 is visible, showing the housing bracket 40, the housing mount 42, the rotatable joint 44 between the housing bracket 40 and the housing mount 42. The housing mount 42 is fixedly attached to the ratchet 54, which accommodates a ratchet rod 52 to enable the crank 56 to raise and lower the light fixture 10. The rotatable joint 44 permits rotational angling of the light fixture 10 in the desired direction. The base 48 is provided with casters 50, for easy mobility of the light fixture 10.

Figure 3:
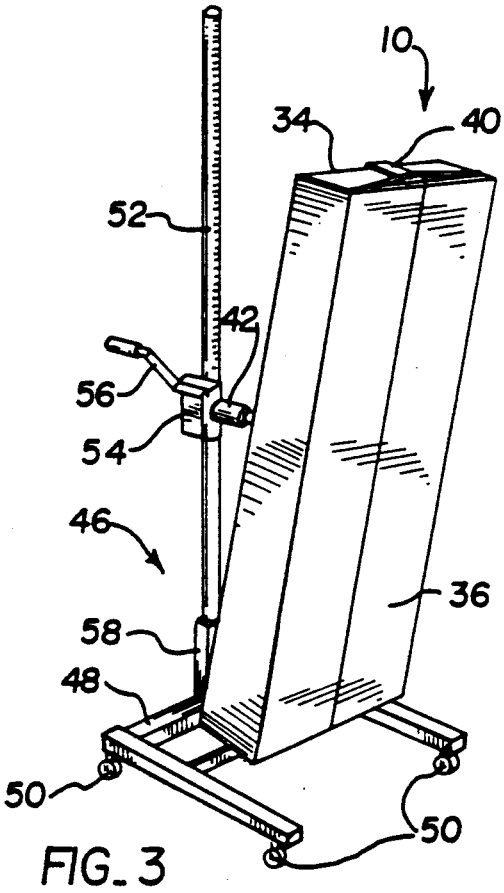
FIG. 3 illustrates the present fixture in its closed configuration, ready for storage.

Referring now to FIG. 3, the light fixture 10 of FIGS. 1 and 2 is shown in its compact, folded configuration for storage. The housing doors 36 are closed; the ratchet 54 is in its lowest progressive position on the ratchet rod 52, and the rotatable joint 44 is oriented to hold the housing body 34 in a substantially vertical position. In its configuration as illustrated in FIG. 3, the present invention can be easily rolled to a storage area, where it requires only a compact storage space.

Figure 4:
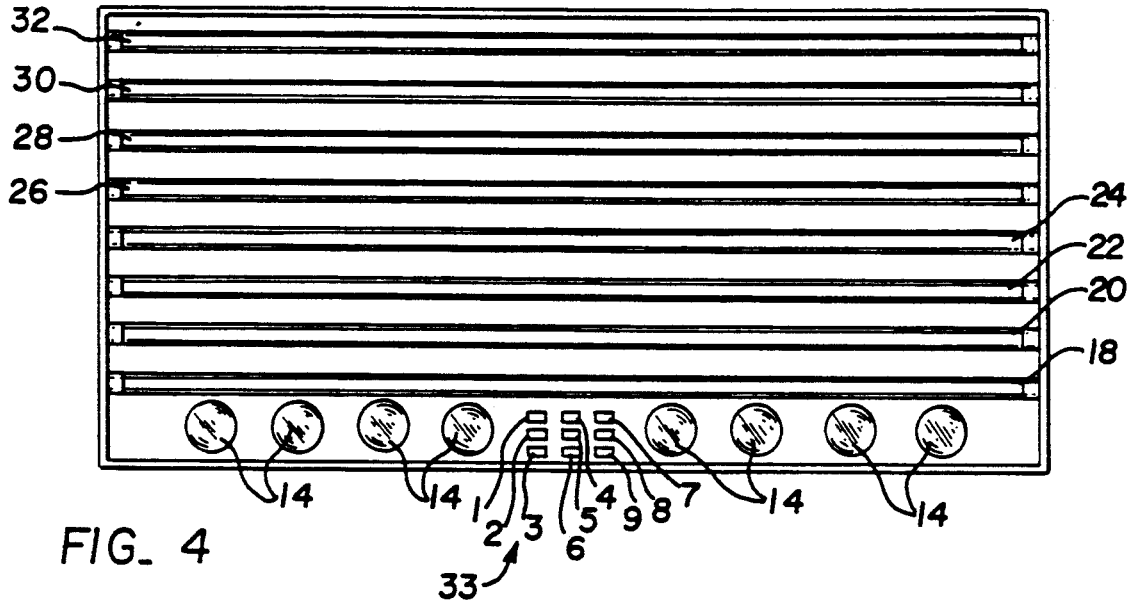
FIG. 4 illustrates the light panel of the present invention.

Referring now to FIG. 4, the eight incandescent lamps 14 and the eight fluorescent lamps 18, 20, 22, 24, 26, 28, 30, and 32 are shown in the configuration which forms the design of the present invention. Also shown are the nine switches 1, 2, 3, 4, 5, 6, 7, 8, 9, one of which (1) is an on-off switch for all of the incandescent lamps, and the remaining eight of which (2, 3, 4, 5, 6, 7, 8, 9) separately switch each of the eight fluorescent lamps 18, 20, 22, 24, 26, 28, 30 and 32. By means of the use of particular lamp selections and specified switching patterns, light of a particular spectral distribution is emitted to duplicate the daylight chromaticity for a given color or color family.

Applicants have identified specific lamp types which make possible the color mode switching of the present invention. The eight incandescent lamps 14 are standard clear incandescent bulbs, the center six of which are 25 watt bulbs with the incandescent lamps on each end being 60 watt bulbs. The eight fluorescent lamps are each of a specific type. For the purpose of illustration in FIG. 4, and for the purpose of correlation with the circuit/socket diagram of FIG. 5 which identifies the switching arrangement, these fluorescent lamps are shown in a particular order. In the context of the invention, however, the fluorescent lamps may be mounted in any order, as long as appropriate switching changes are made accordingly.

Although commercially available fluorescent lamps are suitable for use in the present device, the fluorescent lamps may be described independently by their specifications and by the x and y coordinates according to the CIE Chromaticity System known in the art. FIGS. 6–13 illustrate the spectral power distribution for each of the fluorescent lamps 18, 20, 22, 24, 26, 28, 30 and 32, respectively.

For each of the fluorescent lamps 18, 20, 22, 24, 26, 28, 30 and 32, objective specifications identify each fluorescent lamp. These specifications are listed below.

Fluorescent lamp 18 has the following characteristics:

| | | |
|---|---|---|
| Lamp | F-40 | |
| Diameter | T-10 | |
| Base | Medium Bipin | |
| Correlated Color Temperature | 3000° Kelvin | x = .440 (.438–.442) |
| Color Rendering Index | 85 @ 3000° K. | y = .406 (.404–.408) |
| Initial Lumen Rating* | 3,450 | |
| Rated Life (hours) @ 3 hrs/start | 34,000 | |

Fluorescent lamp 20 has the following characteristics:

| | | |
|---|---|---|
| Lamp | F-40 | |
| Diameter | T-10 | |
| Base | Medium Bipin | |
| Correlated Color Temperature | 4000° Kelvin | x = .375 (.373–.377) |
| Color Rendering Index | 85 @ 4000° K. | y = .380 (.378–.382) |
| Initial Lumen Rating* | 3,450 | |
| Rated Life (hours) @ 3 hrs/start | 34,000 | |

Fluorescent lamp 22 has the following characteristics:

| | | |
|---|---|---|
| Lamp | F-40 | |
| Diameter | T-12 | |
| Base | Medium Bipin | |
| Correlated Color Temperature | 4100° Kelvin | x = .376 (.374–.378) |
| Color Rendering Index | 82 @ 4100° K. | y = .387 (.385–.389) |
| Initial Lumen Rating* | 3,375 | |
| Rated Life (hours) @ 3 hrs/start | 20,000 | |

Fluorescent lamp 24 has the following characteristics:

| | | |
|---|---|---|
| Lamp | F-40 | |
| Diameter | T-10 | |
| Base | Medium Bipin | |
| Correlated Color Temperature | 5000° Kelvin | x = .345 (.343–.347) |
| Color Rendering Index | 85 @ 5000° K. | y = .359 (.357–.361) |
| Initial Lumen Rating* | 3,450 | |
| Rated Life (hours) @ 3 hrs/start | 34,000 | |

Fluorescent lamp 26 has the following characteristics:

| | | |
|---|---|---|
| Lamp | F-40 | |
| Diameter | T-12 | |
| Base | Medium Bipin | |
| Correlated Color Temperature | 5000° Kelvin | x = .346 (.344–.348) |
| Color Rendering Index | 92 @ 5000° K. | y = .359 (.357–.361) |
| Initial Lumen Rating* | 2,200 | |
| Rated Life (hours) @ 3 hrs/start | 20,000 | |

Fluorescent lamp 28 has the following characteristics:

| | | |
|---|---|---|
| Lamp | F-40 | |
| Diameter | T-12 | |
| Base | Medium Bipin | |
| Correlated Color Temperature | 6250° Kelvin | x = .313 (.311–.315) |
| Color Rendering Index | 75 @ 6250° K. | y = .337 (.335–.339) |
| Initial Lumen Rating* | 2,600 | |
| Rated Life (hours) @ 3 hrs/start | 20,000 | |

Fluorescent lamp 30 has the following characteristics:

| | | |
|---|---|---|
| Lamp | F-40 | |
| Diameter | T-12 | |
| Base | Medium Bipin | |
| Correlated Color Temperature | 6250° Kelvin | x = .313 (.311–.315) |
| Color Rendering Index | 75 @ 6250° K. | y = .337 |

-continued

| | | |
|---|---|---|
| | | (.335–.339) |
| Initial Lumen Rating* | 2,600 | |
| Rated Life (hours) @ 3 hrs/start | 20,000 | |
| Fluorescent lamp 32 has the following characteristics: | | |
| Lamp | F-40 | |
| Diameter | T-12 | |
| Base | Medium Bipin | |
| Correlated Color Temperature | 7500° Kelvin | x = .300 (.298–.302) |
| Color Rendering Index | 95 @ 7500° K. | y = .312 (.310–.314) |
| Initial Lumen Rating* | 2,000 | |
| Rated Life (hours) @ 3 hrs/start | 20,000 | |

*established after 100 hours of operation

For the purpose of meeting these specifications, the following bulbs are exemplary. Fluorescent lamp 18 may be an "Aurora III" (Dynachrome Series) available from V. L. Service Lighting Corporation, 200 Franklin Square Drive, Somerset, N.J., 08873-6810. Fluorescent lamp 20 may be an "Aurora IV," and Fluorescent lamp 24 may be an "Aurora IV," both also available from V. L. Service Lighting. Fluorescent lamp 22 may be an "SPX41" (Deluxe Color) available from General Electric, with the remaining fluorescent lamps 26, 28, 30 and 32 suitably being the General Electric bulbs "C-50," "D-40," "D-40," and "C-75." Any fluorescent lamp is suitable for use in the present invention as any of fluorescent lamps 18, 20, 22, 24, 26, 28, 30, 32 as long as the specifications listed above are met with respect to the chromaticity coordinates x and y.

Figure 5:
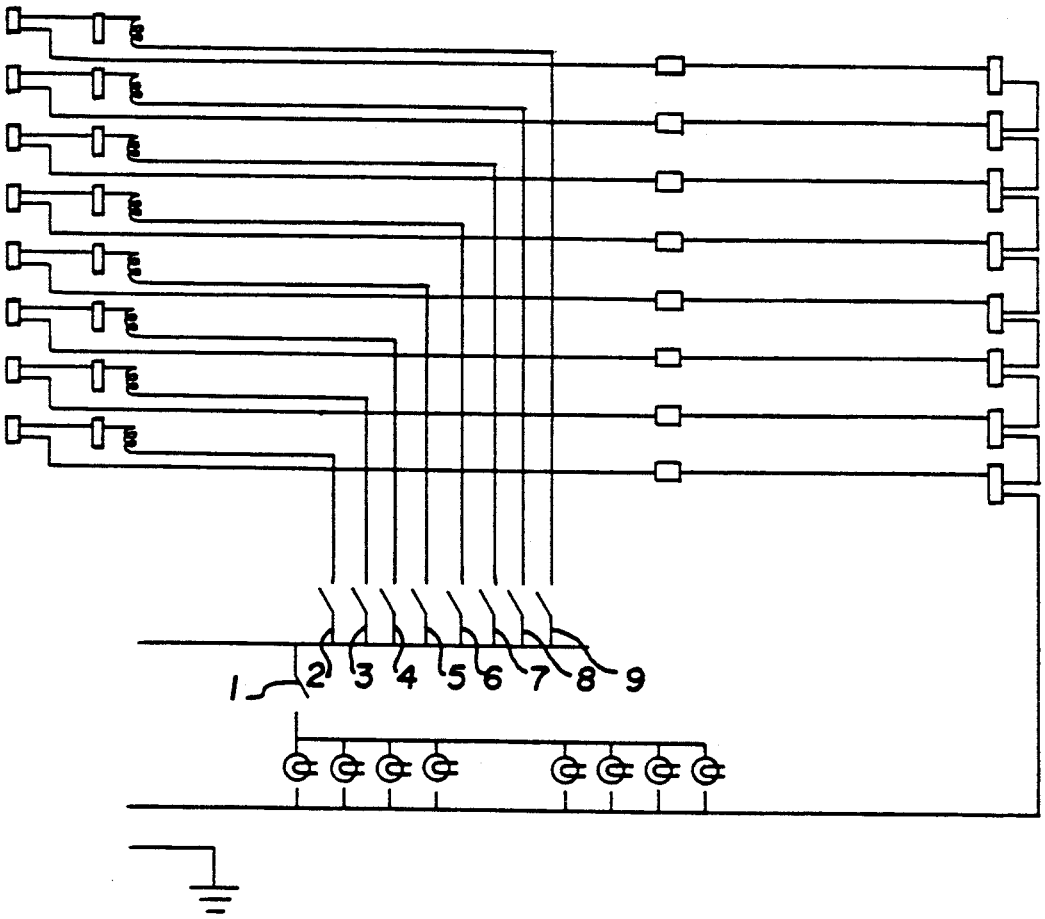
FIG. 5 is a schematic circuit/socket diagram of the light panel of the present invention.
Figure 6:
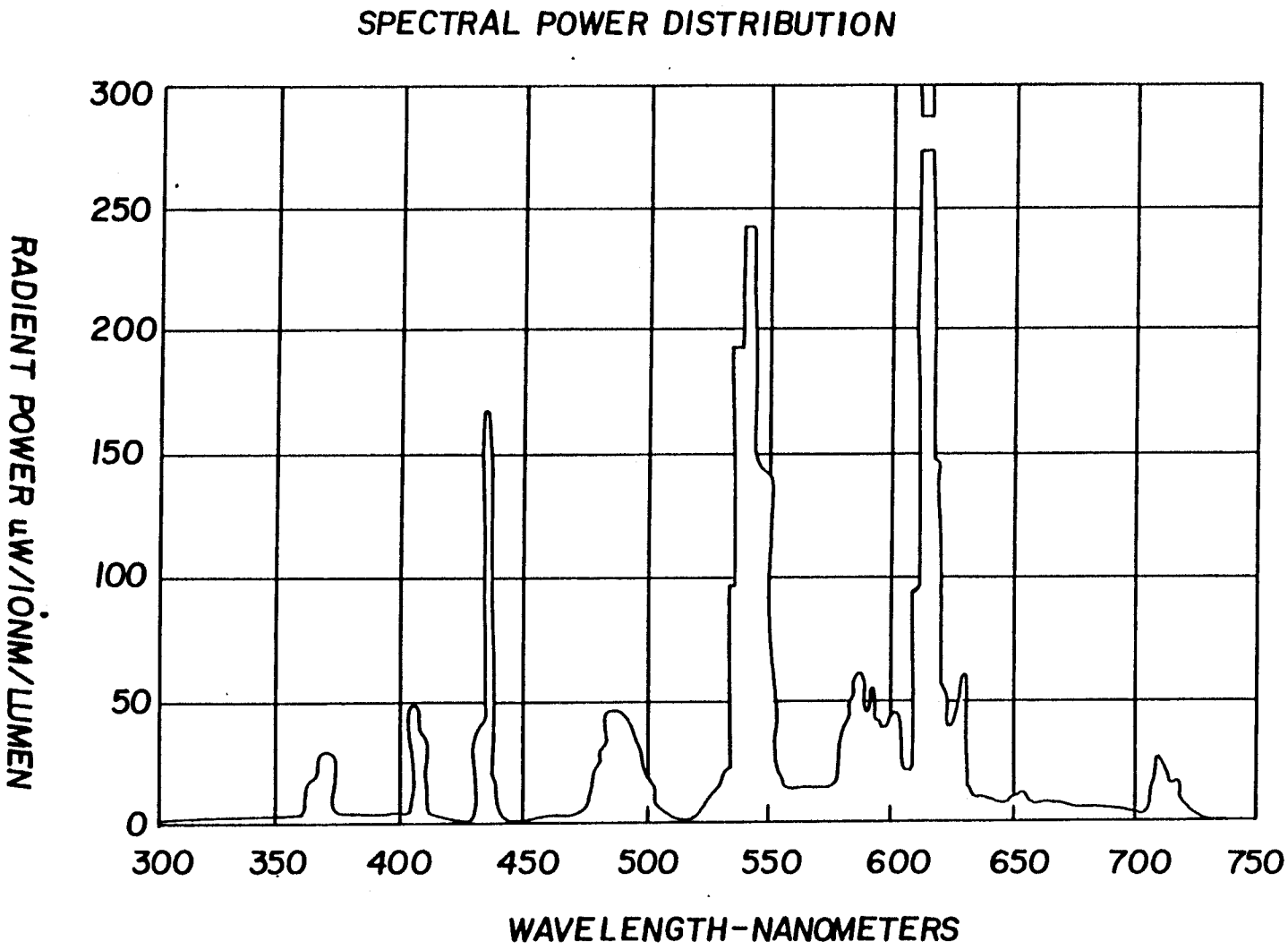
FIGS. 6–13 illustrate the spectral power distribution for each of the fluorescent lamps of the present invention.
Figure 7:
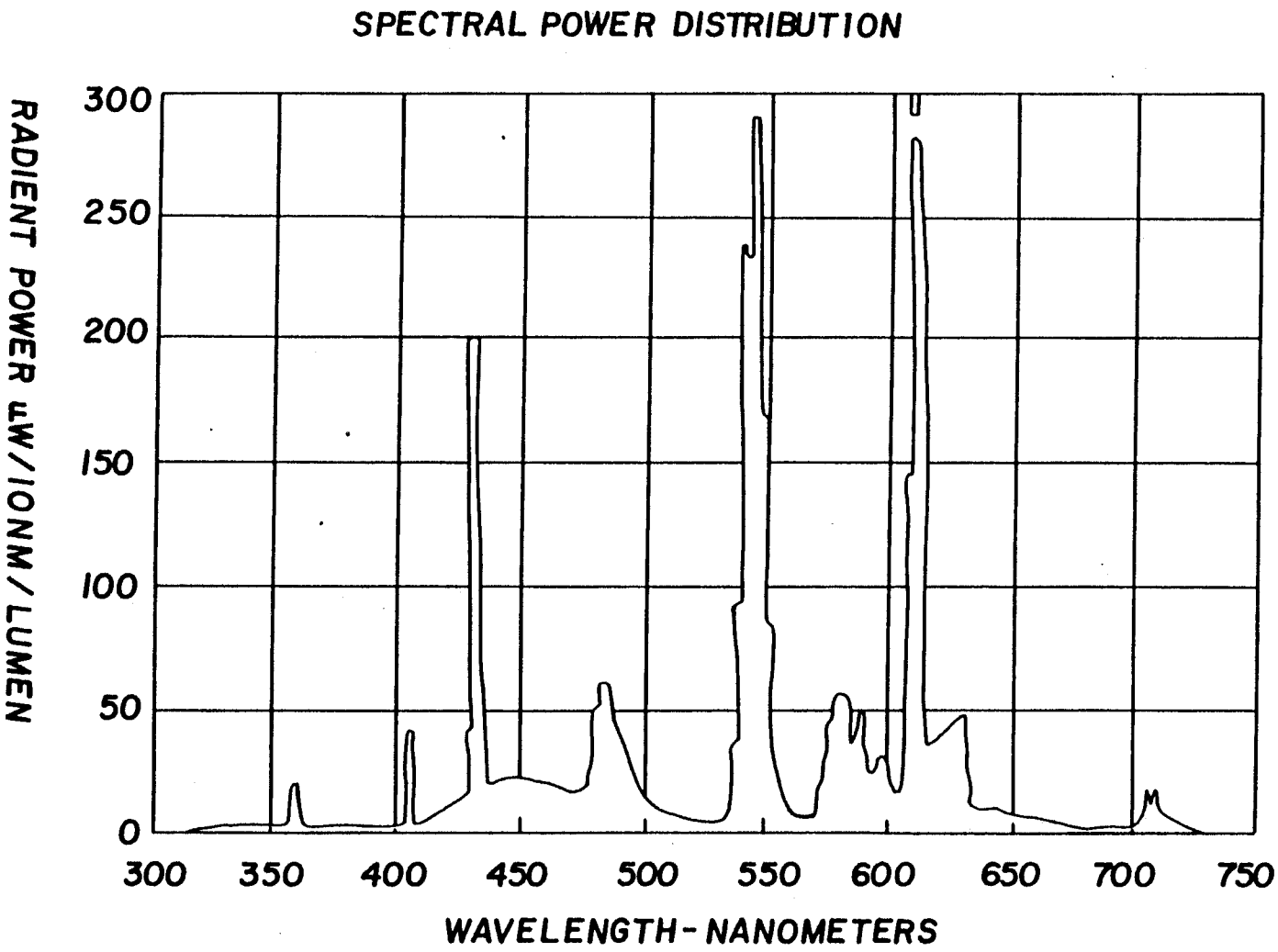
Figure 8:
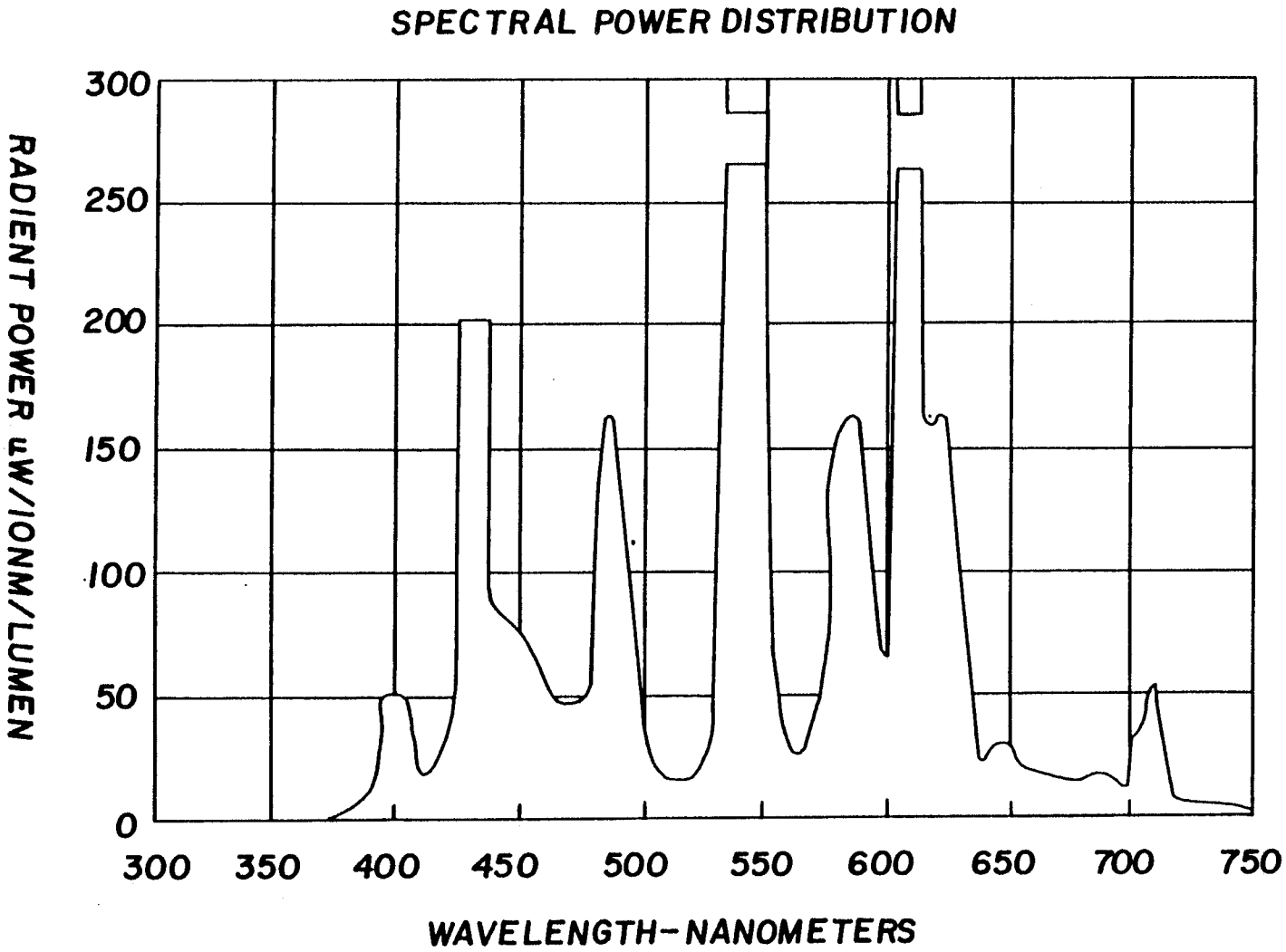
Figure 9:
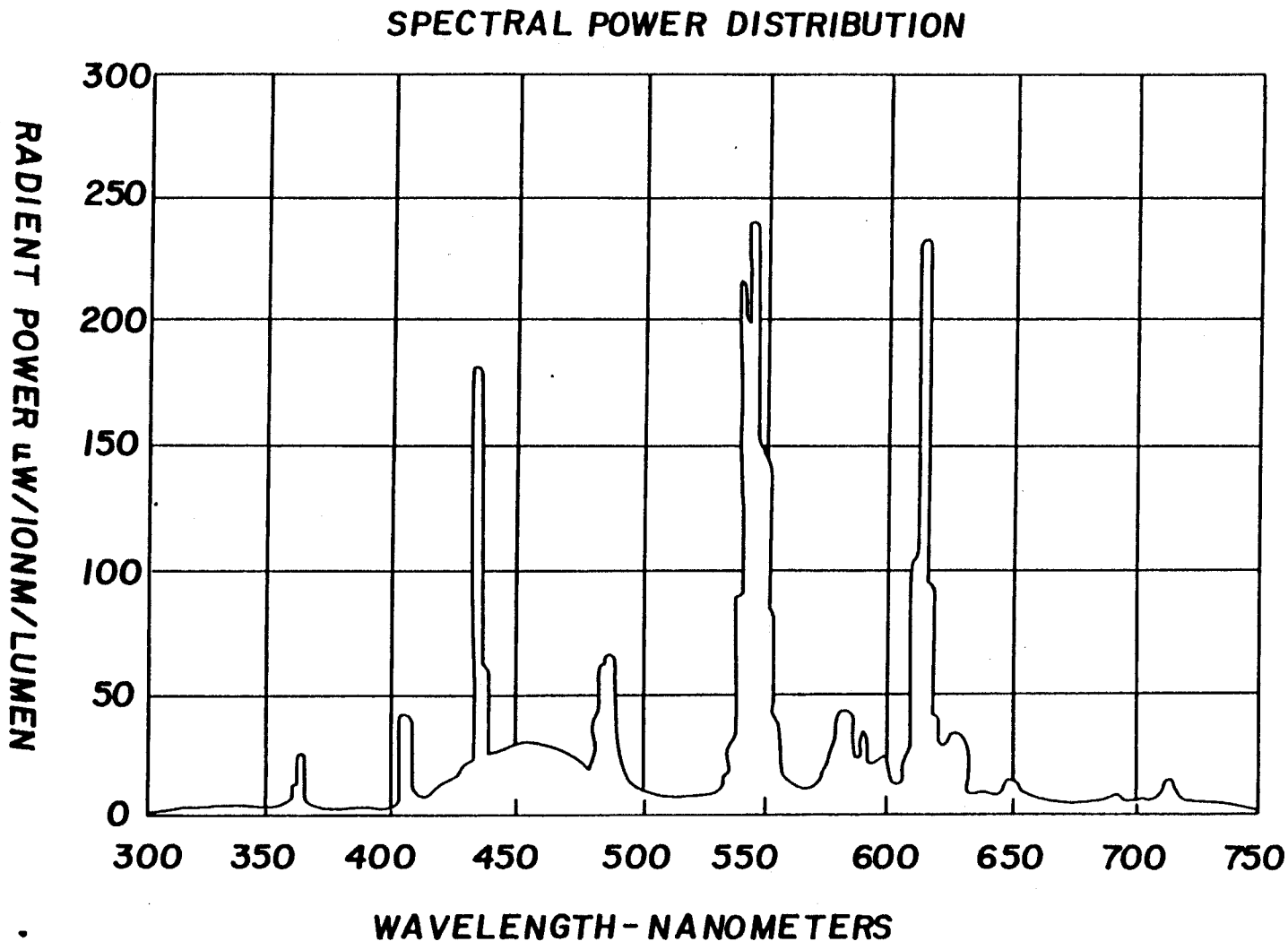
Figure 10:
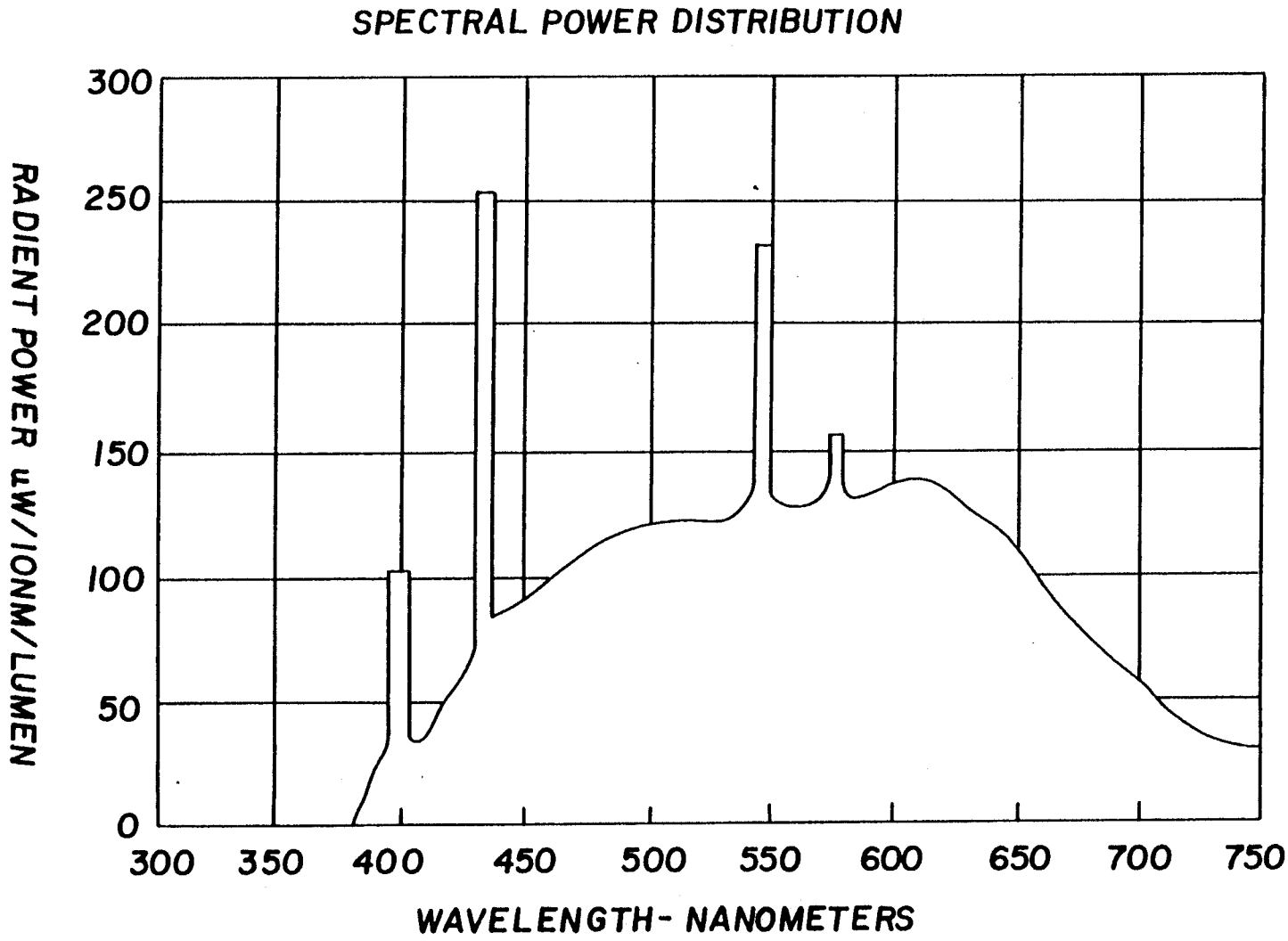
Figure 11:
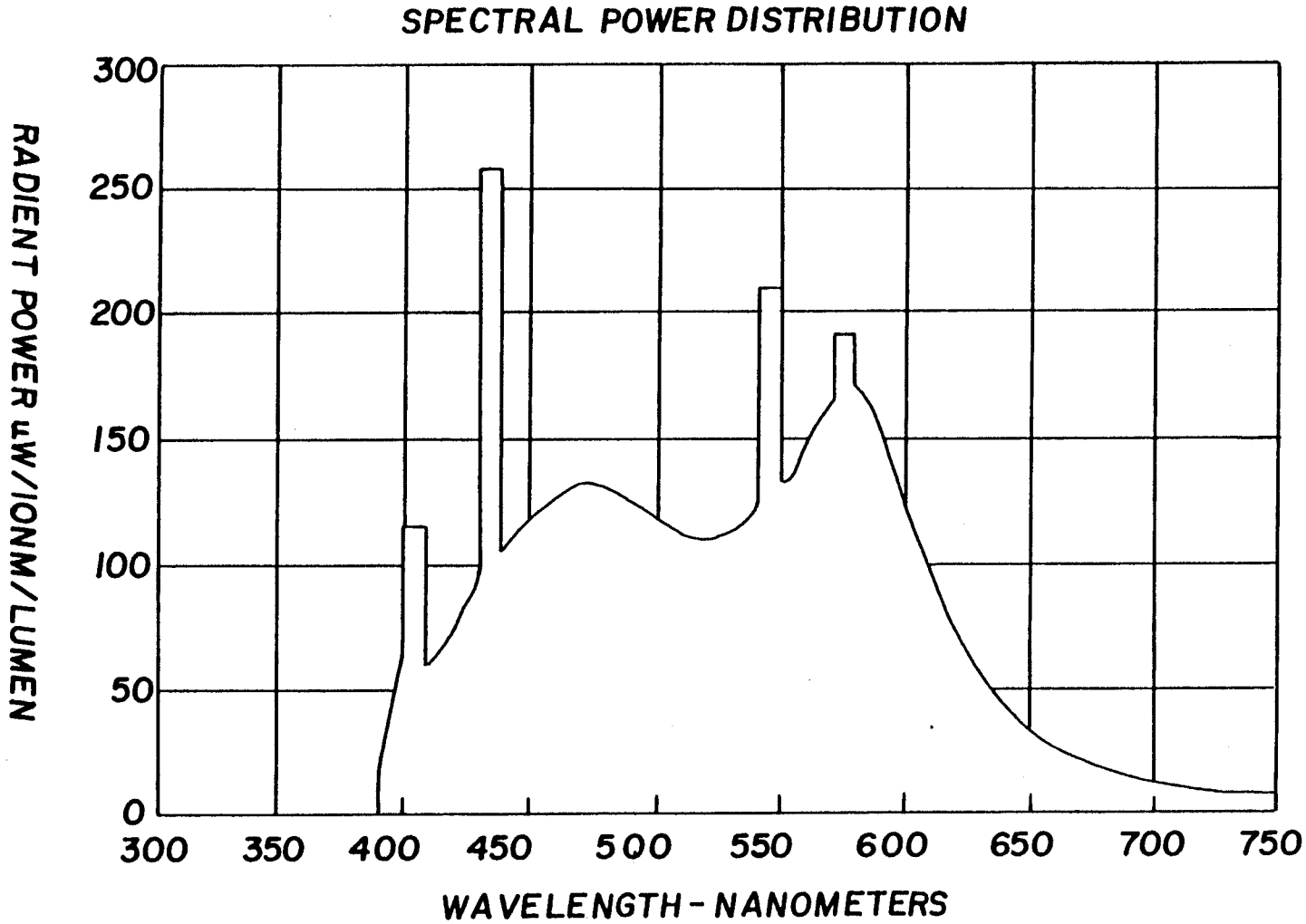
Figure 12:
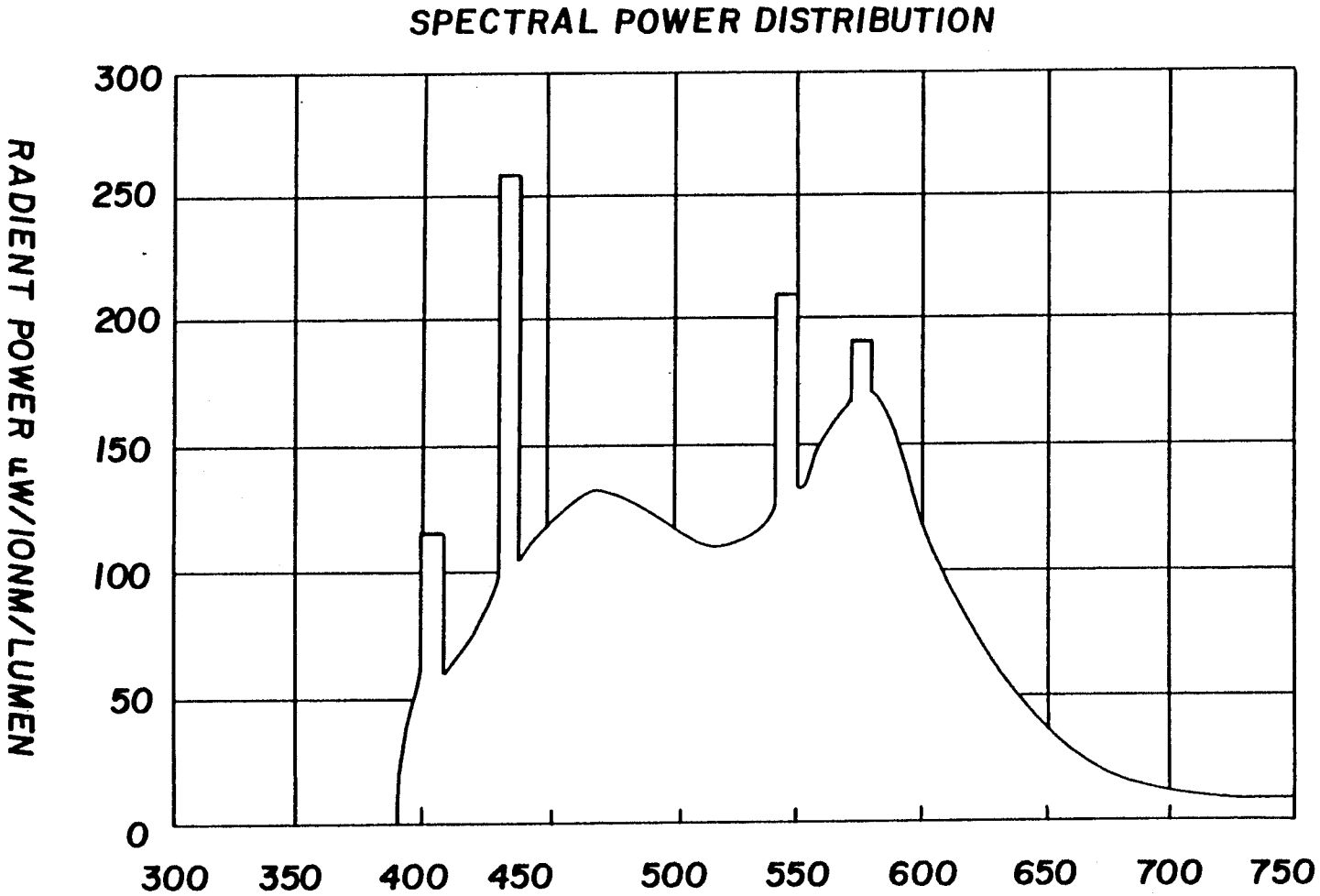
Figure 13:
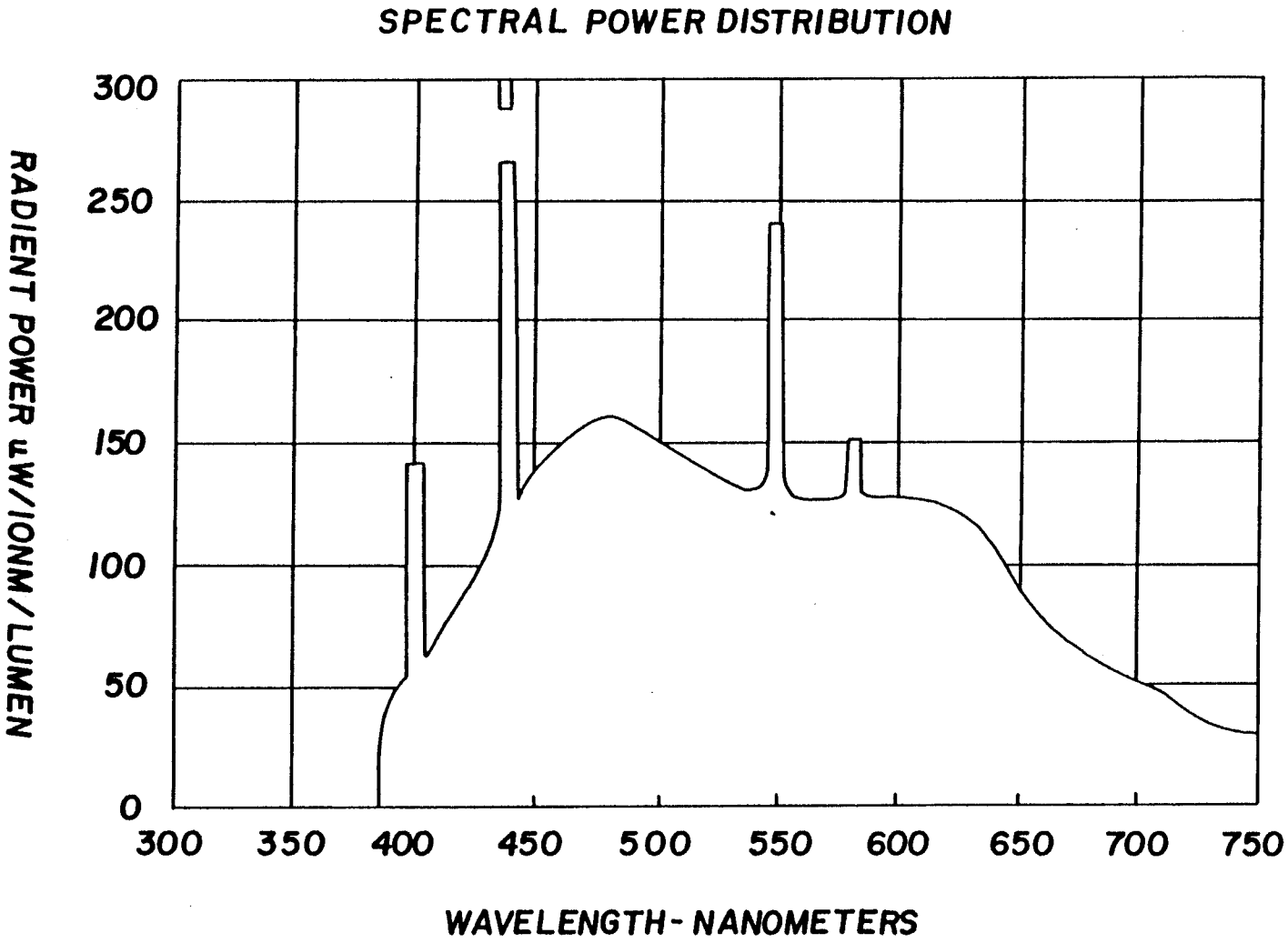

Referring now to FIG. 5, a circuit/socket diagram corresponding to FIG. 4 illustrates the switching configuration of the present design. As is readily seen from a dual reading of FIGS. 4 and 5, switch 1 switches all eight incandescent lamps 14 on or off, switch 2 controls fluorescent lamp 18, and switches 3, 4, 5, 6, 7, 8, 9 switch fluorescent lamps 20, 22, 24, 26, 28, 30, and 32, respectively.

By using a specific switching combination for each color or color family, the present invention emits a spectral distribution of light which enables duplication of daylight chromaticity for each color or color family. For example, the following switching combinations are recommended for duplicating daylight chromaticity for the colors or color families listed.

TABLE I

| Sample Number | Switching Combination* | Color Name |
|---|---|---|
| 1 | 56789 | Medium Blue |
| 2 | 56789 | Light Blue |
| 3 | 35678 | Grey |
| 4 | 356789 | Silver |
| 5 | 3456789 | White |
| 6 | 567 | Green |
| 7 | 134568 | Yellow |
| 8 | 156789 | Bright Red |
| 9 | 1234 | Dark Beechwood |
| 10 | 134 | Medium Walnut |
| 11 | 1456 | Light Mesa Broad |
| 12 | 14789 | Flax |
| 13 | 1789 | Light Wheat |

*If the switch number is not listed, the switch should be off.

The samples 1–13 identified above were subjected to comparison chromaticity readings in both noon daylight and beneath the present invention switched as described, and the variations in the chromaticity were insignificant and did not significantly affect the color match.

As a practical matter, the present light fixture 10 can be switched so as to show the true color of any specimen subjected to its illumination. On an even more practical level, however, for paint matching, the following technique is effective. First, the practitioner applies paint to a test panel until hiding is achieved. Next, the color or color family identified above, closest to the color to be matches is selected. The switch configuration for the color or color family should be used to turn on the light fixture 10. The test panel should be affixed (with tape or magnet) next to the area to be matched, and the light fixture 10 should be positioned two to three feet from that area. If the colors match, the light fixture 10 should be returned to its storage position and paint application may proceed. If colors do not match, the paint should be tinted, applied to another portion of a test panel, and viewing under the light fixture 10 should be repeated until a match is achieved.

Although the invention has been described particularly with respect to materials and methods above, the invention is to be limited only insofar as is set forth in the accompanying claims.

We claim:

1. A device for color mode switching, comprising a plurality of incandescent lamps, and eight first, second, third, fourth, fifth, sixth, seventh and eighth fluorescent lamps have the following chromaticity coordinates, respectively:

| | |
|---|---|
| x = .438–.442, | y = .404–.408 |
| x = .373–.377, | y = .378–.382 |
| x = .374–.378, | y = .385–.389 |
| x = .343–.347, | y = .357–.361 |
| x = .344–.348, | y = .357–.361 |
| x = .311–.315, | y = .335–.339 |
| x = .311–.315, | y = .335–.339 |
| x = .298–.302, | y = .310–.314, |

wherein said incandescent lamps are switched together, further wherein each of said fluorescent lamps is switched separately, further wherein a first switch controls said incandescent lamps, and a second, third, fourth, fifth, sixth, seventh, eighth and ninth switch controls said first, second, third, fourth, fifth, sixth, seventh and eighth fluorescent lamp, respectively, and further wherein the following switching combinations enable spectral emission of light which substantially duplicates the daylight chromaticity of the following colors:

| Switching Combination | Color Name |
|---|---|
| 56789 | Medium Blue |
| 56789 | Light Blue |
| 35678 | Grey |
| 356789 | Silver |
| 3456789 | White |
| 567 | Green |
| 134568 | Yellow |
| 156789 | Bright Red |
| 1234 | Dark Beechwood |
| 134 | Medium Walnut |
| 1456 | Light Mesa Broad |
| 14789 | Flax |
| 1789 | Light Wheat, |

2. The device according to claim 1 wherein aid first, second, third, fourth, fifth, sixth, seventh, and eighth fluorescent lamps have the following chromaticity coordinates and correlated color temperature:

| | |
|---|---|
| x = .440, | y = .406, 3,000° K. |
| x = .375, | y = .380, 4,000° K. |
| x = .376, | y = .387, 4,100° K. |
| x = .345, | y = .359, 5,000° K. |
| x = .346, | y = .359, 5,000° K. |
| x = .313, | y = .337, 6,250° K. |
| x = .313, | y = .337, 6,250° K. |

-continued

| | |
|---|---|
| x = .300, | y = .312, 7,500° K. |

3. The device according to claim 2 wherein each of said lamps comprises a light panel included within a housing body, said housing body having housing doors having a reflective surface on the inner surfaces thereof.

4. The device according to claim 2 wherein said housing body is provided with a housing bracket, a housing mount rotatably attached to said housing bracket, wherein said housing mount is fixedly attached to a ratchet cooperatively engaged with a ratchet rod affixed to a base.

* * * * *

UNITED STATES PATENT AND TRADEMARK OFFICE

CERTIFICATE OF CORRECTION

PATENT NO. : 5,060,118

DATED : October 22, 1991

INVENTOR(S) : Richard J. Penrod and Roy J. McCullagh

It is certified that error appears in the above-identified patent and that said Letters Patent is hereby corrected as shown below:

On the title page, under References Cited U.S. PATENT DOCUMENTS "4,404,619 9/1983 Ferpuson 362/375" should read --4,404,619 9/1983 Ferguson 362/375--.

Claim 2 Line 1 Column 7 "aid" should read --said--.

Claim 4 Line 9 Column 8 "2" should read --3--.

Signed and Sealed this

Twentieth Day of April, 1993

*Attest:*

MICHAEL K. KIRK

*Attesting Officer*

*Acting Commissioner of Patents and Trademarks*